US008525768B2

(12) United States Patent
Liu

(10) Patent No.: US 8,525,768 B2
(45) Date of Patent: Sep. 3, 2013

(54) GATE LINE CIRCUIT FOR GENERATING DRIVING SIGNAL HAVING SLOWER RISING AND FALLING EDGE SLOPES

(75) Inventor: Ping-Lin Liu, Tainan (TW)

(73) Assignee: Chimei Innolux Corporation, Chu-Nan (TW)

( * ) Notice: Subject to any disclaimer, the term of this patent is extended or adjusted under 35 U.S.C. 154(b) by 579 days.

(21) Appl. No.: 12/648,116

(22) Filed: Dec. 28, 2009

(65) Prior Publication Data

US 2010/0164943 A1 Jul. 1, 2010

(30) Foreign Application Priority Data

Dec. 29, 2008 (TW) ..... 97151282 A

(51) Int. Cl.
*G09G 3/36* (2006.01)

(52) U.S. Cl.
USPC ..... 345/94; 345/208

(58) Field of Classification Search
USPC ..... 345/94
See application file for complete search history.

(56) References Cited

U.S. PATENT DOCUMENTS

| | | | | |
|---|---|---|---|---|
| 6,882,209 | B1 * | 4/2005 | Isbara | 327/390 |
| 7,164,405 | B1 * | 1/2007 | Jeong et al. | 345/94 |
| 2001/0033266 | A1 * | 10/2001 | Lee | 345/94 |
| 2006/0071896 | A1 * | 4/2006 | Nakata et al. | 345/94 |
| 2011/0187690 | A1 * | 8/2011 | Nakatsuka | 345/208 |

FOREIGN PATENT DOCUMENTS

JP 2008191375 8/2008

* cited by examiner

*Primary Examiner* — Kwang-Su Yang
(74) *Attorney, Agent, or Firm* — Liu & Liu

(57) ABSTRACT

A display panel includes a gate line circuit. The gate line circuit includes a gate driver, a control circuit and a gate line. The gate driver generates a first driving signal with alternate high and low levels. The first driving signal has a first rising edge and a first falling edge. The control circuit receives the first driving signal and generates a second driving signal. The second driving signal has a second rising edge and a second falling edge. The second rising edge and the second falling edge are respectively smoother than the first rising edge and the first falling edge. The control circuit includes at least one capacitor. The capacitor is charged in a first direction in response to the first rising edge of the first driving signal. The capacitor is charged in a second direction in response to the first falling edge of the first driving signal.

9 Claims, 11 Drawing Sheets

GATE LINE CIRCUIT FOR GENERATING DRIVING SIGNAL HAVING SLOWER RISING AND FALLING EDGE SLOPES

FIELD OF THE INVENTION

The present invention relates to a gate line circuit, and more particularly to a gate line circuit of a display panel. The present invention also relates to a display system having such a display panel.

BACKGROUND OF THE INVENTION

FIG. 1 is a schematic circuit diagram illustrating a typical display panel. As shown in FIG. 1, the display panel comprises multiple pixel elements 101~126, which are arranged in an array. Each of the pixel elements 101~126 comprises a storage unit c101~c126 and a switch unit m101~m126. For example, the storage units c101~c126 are capacitors, and the switch units m101~m126 are transistors. In addition, the display panel further comprises multiple gate lines g1~g3 and multiple data lines d1~d6. When the switch units m101~m126 are controlled by a gate control unit (not shown), corresponding pixel data are inputted and stored into respective storage unit c101~c126 via the data lines d1~d6. As the size of the display panel is increased, there are more pixel elements, gate lines and data lines on the display panel.

Generally, the display panel of FIG. 1 could be applied to an AMOLED (active matrix organic light emitting diode) device or a LCD (liquid crystal display) device.

FIG. 2A is a schematic circuit diagram illustrating a gate line circuit according to the prior art. The gate line circuit comprises a gate driver 230, a gate line 240 and n pixel elements 211~21*n*. As shown in FIG. 2A, these pixel elements 211~21*n* are enabled or disabled according to the on/off statuses of respective switch units m211~m21*n*. Moreover, the output terminal of the gate driver 230 connects to the gate line 240, and the gate line 240 connects to the switch units m211~m21*n*. Similarly, the switch units m211~m2 in are transistors. For controlling the on/off statuses of the switch units m211~m21*n*, the gate driver 230 generates a driving signal having alternate high and low levels. When the driving signal is at the high-level state, the switch units m211~m21*n* are turned on. Whereas, when the driving signal is at the low-level state, the switch units m211~m21*n* are turned off. Generally, the gate control unit of the display panel comprises multiple gate drivers 230. For illustration and brevity, only one gate driver 230 is shown in the drawings.

FIG. 2B is a schematic circuit diagram illustrating an equivalent circuit of the gate line circuit shown in FIG. 2A. As shown in FIG. 2B, the switch units m211~m21*n* are equivalent to respective capacitors c1~cn, and the gate line 240 are equivalent to multiple serially-connected resistors r1~rn. Since the high-level state and the low-level state of the driving signal are quickly alternated, the rising edge slope and the falling edge slope at the output terminal of the gate driver 230 are very sharp. Whereas, when the driving signal is transmitted to the last (i.e. the $n^{th}$) switch unit cn, the rising edge slope and the falling edge slope become smoother.

FIG. 2C is a plot illustrating the variations of gate voltages at the first switch unit and the last switch unit of the equivalent circuit shown in FIG. 2B. The curve I indicates the variation of the gate voltage at the first switch unit c1; and the curve II indicates the variation of the gate voltage at the last switch unit cn. After the driving signal is switched from the high-level state to the low-level state for a time period Δt1, the gate voltage at the first switch unit c1 indicates that the first switch unit c1 is completely turned off (see the curve I). On the other hand, the gate voltage at the last switch unit cn is still too high, indicating that the last switch unit cn is not completely turned off (see the curve II). Under this circumstance, a so-called feed-through voltage effect occurs. Due to the feed-through voltage effect, the brightness or the images shown on the display panel are usually inconsistent.

For solving the above drawbacks, a large resistor R is serially connected with the gate line. FIG. 3A is a schematic circuit diagram illustrating another equivalent circuit of the gate line circuit according to the prior art. As shown in FIG. 3A, a large resistor R is connected between the output terminal of the gate driver 230 and the first switch unit c1 in series. In other words, the driving signal will be firstly transmitted across the large resistor R and then transmitted to the first switch unit c1. Since the large resistor R is serially connected to the gate line, the charge/discharge time constant of the first switch unit c1 is increased. When the driving signal is transmitted to the first switch unit c1, the rising edge slop and the falling edge slop of the driving signal become smoother.

FIG. 3B is a plot illustrating the variations of gate voltages at the first switch unit and the last switch unit of the equivalent circuit shown in FIG. 3A. The curve III indicates the variation of the gate voltage at the first switch unit c1; and the curve IV indicates the variation of the gate voltage at the last switch unit cn. After the driving signal is switched from the high-level state to the low-level state for a time period Δt2, the gate voltage at the first switch unit c1 indicates that the first switch unit c1 is completely turned off (see the curve III). On the other hand, the gate voltage at the last switch unit cn also indicates that the last switch unit cn is also completely turned off (see the curve IV). That is, after the driving signal is switched from the high-level state to the low-level state for a time period Δt2, the switch units c1~cn are almost completely turned off at the same time. Therefore, the brightness or the images shown on the display panel will become more consistent.

FIG. 4 is a schematic circuit diagram illustrating an equivalent circuit of another gate line circuit according to the prior art. As shown in FIG. 4, a large capacitor C is connected between the output terminal of the gate driver 230 and the ground terminal. In other words, the driving signal will be firstly transmitted across the large capacitor C and then transmitted to the first switch unit c1 . Since the large capacitor C is connected to the gate line in parallel, the charge/discharge time constant of the first switch unit c1 is increased. In other words, when the driving signal is transmitted to the first switch unit c1, the rising edge slope and the falling edge slope of the driving signal become smoother.

The gate line circuits as shown in FIGS. 3A and 4, however, still have some drawbacks. For example, the large capacitor C or the large resistor R will occupy a large layout area of the display panel. In addition, the large resistor R will increase the power consumption of the display panel.

SUMMARY OF THE INVENTION

The present invention relates to a gate line circuit of a display panel by using a small-area control circuit to generate a smoother driving signal.

In accordance with an aspect of the present invention, there is provided a display panel including a gate line circuit. The gate line circuit includes a gate driver, a control circuit and a gate line. The gate driver has an output terminal for generating a first driving signal with alternate high and low levels, wherein the first driving signal has a first rising edge and a first falling edge. The control circuit has an input terminal connected to the output terminal of the gate driver for receiving the first driving signal and an output terminal for generating a second driving signal, wherein the second driving signal has a second rising edge and a second falling edge. The second rising edge and the second falling edge of the second driving signal are respectively smoother than the first rising edge and the first falling edge of the first driving signal. The gate line is connected to the output terminal of the control circuit. The control circuit includes at least one capacitor. The capacitor is charged in a first direction in response to the first rising edge of the first driving signal. The capacitor is charged in a second direction in response to the first falling edge of the first driving signal.

In accordance with another aspect of the present invention, there is provided an image display system. The image display system includes a display panel and a power supply. The display panel has the gate line circuit of the present invention. The power supply is electrically connected to the display panel for providing electric energy to power the display panel.

BRIEF DESCRIPTION OF THE DRAWINGS

The above contents of the present invention will become more readily apparent to those ordinarily skilled in the art after reviewing the following detailed description and accompanying drawings, in which.

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

The present invention provides a gate line circuit. The gate line circuit comprises a gate driver, a control circuit and a gate line. The control circuit is interconnected between the gate driver and a first switch unit. By means of the control circuit, the rising edge slope and the falling edge slop of the driving signal become smoother. The control circuit is implemented by transistors, and thus the layout area could be largely reduced.

Figure 1:
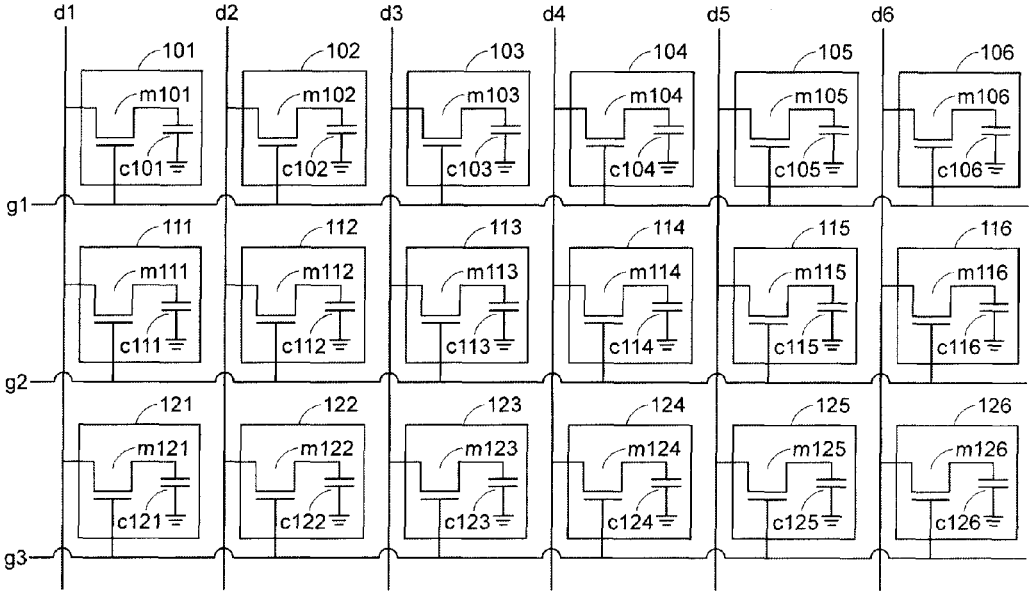
FIG.1 PRIOR ART
FIG. 1 is a schematic circuit diagram illustrating a typical display panel.
Figure 2A:
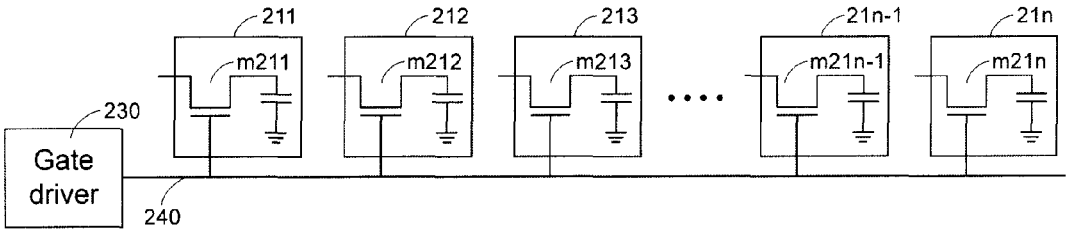
FIG.2A PRIOR ART
FIG. 2A is a schematic circuit diagram illustrating a gate line circuit according to the prior art.
Figure 2B:
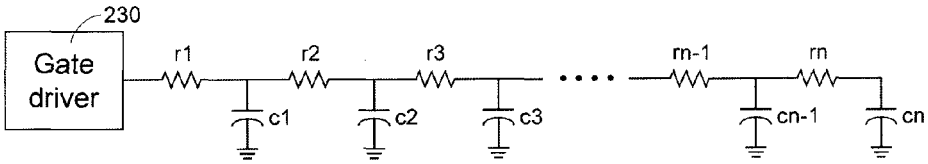
FIG.2B PRIOR ART
FIG. 2B is a schematic circuit diagram illustrating an equivalent circuit of the gate line circuit shown in FIG. 2A.
Figure 2C:
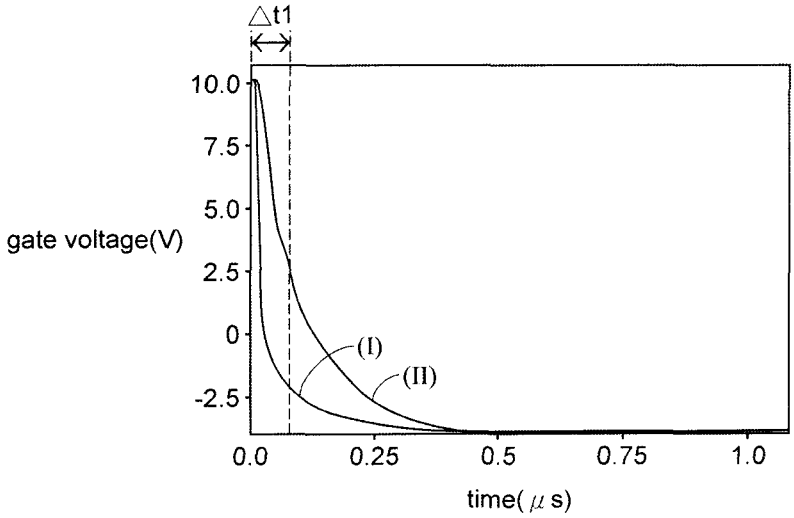
FIG.2C PRIOR ART
FIG. 2C is a plot illustrating the variations of gate voltages at the first switch unit and the last switch unit of the equivalent circuit shown in FIG. 2B.
Figure 3A:
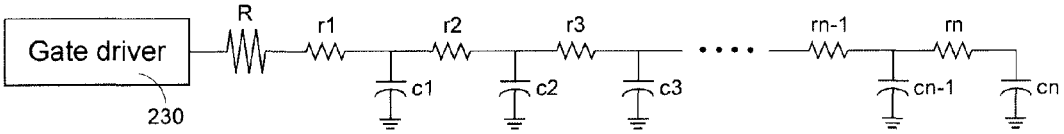
FIG.3A PRIOR ART
FIG. 3A is a schematic circuit diagram illustrating another equivalent circuit of the gate line circuit according to the prior art.
Figure 3B:
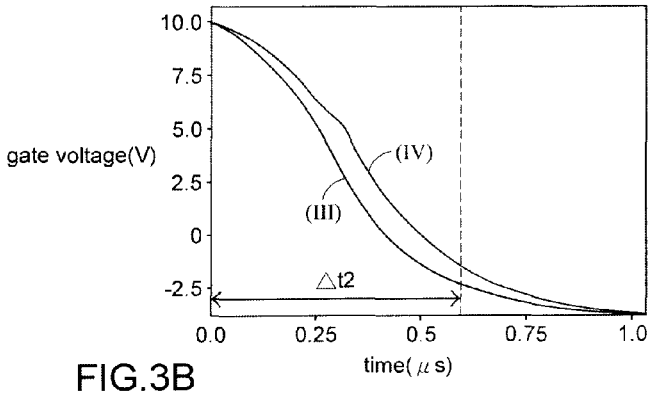
FIG.3B PRIOR ART
FIG. 3B is a plot illustrating the variations of gate voltages at the first switch unit and the last switch unit of the equivalent circuit shown in FIG. 3A.
Figure 4:
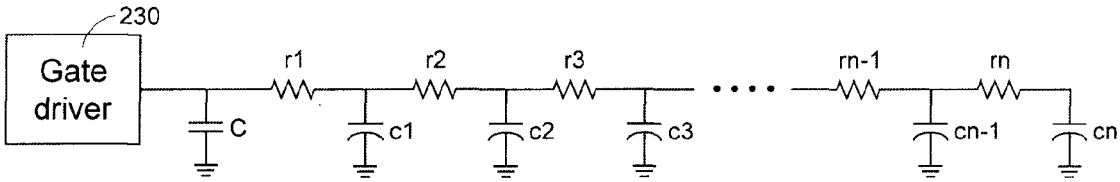
FIG.4 PRIOR ART
FIG. 4 is a schematic circuit diagram illustrating an equivalent circuit of another gate line circuit according to the prior art.
Figure 5A:
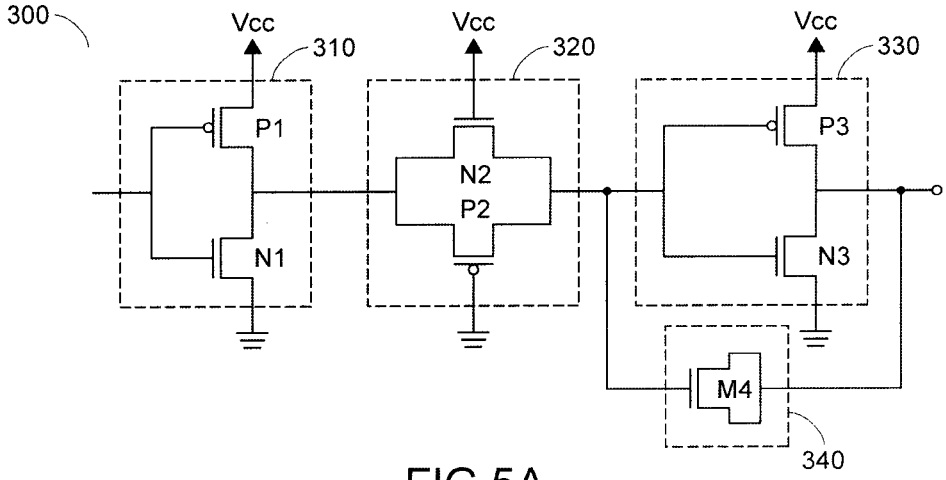
FIG. 5A is a schematic circuit diagram illustrating a control circuit of a display panel according to a first embodiment of the present invention.

FIG. 5A is a schematic circuit diagram illustrating a control circuit of a display panel according to a first embodiment of the present invention. As show in FIG. 5A, the control circuit 300 comprises a first p-type transistor P1, a first n-type transistor N1, a second p-type transistor P2, a second n-type transistor N2, a third p-type transistor P3, a third n-type transistor N3, and a fourth transistor M4. The first p-type transistor P1 and the first n-type transistor N1 are connected with each other to define a first inverter 310. The second p-type transistor P2 and the second n-type transistor N2 are connected with each other to define a transmission gate 320. The third p-type transistor P3 and the third n-type transistor N3 are connected with each other to define a second inverter 330. The source electrode and the drain electrode of the fourth transistor M4 are connected with each other to define a capacitor 340. As such, the gate electrode of the fourth transistor M4 indicates a first end of the capacitor 340, and the drain electrode of the fourth transistor M4 indicates a second end of the capacitor 340. The input terminal of the control circuit 300 is connected to the input terminal of the first inverter 310. The output terminal of the control circuit 300 is connected to the output terminal of the second inverter 330.

The gate electrode of the first p-type transistor P1 and the gate electrode of the first n-type transistor N1 are connected to the input terminal of the first inverter 310. The source electrode of the first p-type transistor P1 is connected to a source voltage Vcc. The drain electrode of the first p-type transistor P1 and the drain electrode of the first n-type transistor N1 are connected to the output terminal of the first inverter 310. The source electrode of the first n-type transistor N1 is connected to a ground terminal.

The gate electrode of the second p-type transistor P2 and the gate electrode of the second n-type transistor N2 are respectively connected to the ground terminal and the source voltage Vcc. The source electrode of the second p-type transistor P2 and the source electrode of the second n-type transistor N2 are connected to the input terminal of the transmission gate 320. The drain electrode of the second p-type transistor P2 and the drain electrode of the n-type transistor N2 are connected to the output terminal of the transmission gate 320.

The gate electrode of the third p-type transistor P3 and the gate electrode of the third n-type transistor N3 are connected to the input terminal of the second inverter 330. The source electrode of the third p-type transistor P3 is connected to the source voltage Vcc. The drain electrode of the third p-type transistor P3 and the drain electrode of the third n-type transistor N3 are connected to the output terminal of the second inverter 330. The source electrode of the third n-type transistor N3 is connected to a ground terminal.

Figure 5B:
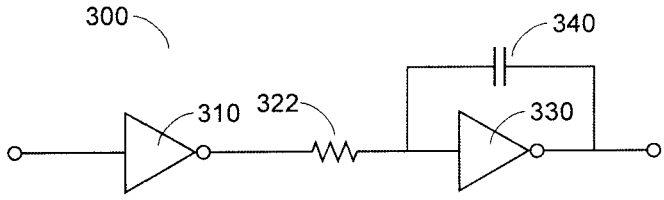
FIG. 5B is a schematic circuit diagram illustrating an equivalent circuit of the control circuit shown in FIG. 5A.

FIG. 5B is a schematic circuit diagram illustrating an equivalent circuit of the control circuit shown in FIG. 5A. In the transmission gate 320, the gate electrode of the second p-type transistor P2 and the gate electrode of the second n-type transistor N2 are respectively connected to the ground terminal and the source voltage Vcc. Therefore, the transmission gate 320 could be considered to be turned on and equivalent to a resistor 322. The input terminal and the output terminal of the transmission gate 320 are respectively a first terminal and a second terminal of the resistor 322. As shown in FIG. 5B, the resistor 322 is serially connected between the output terminal of the first inverter 310 and the input terminal of the second inverter 330. In addition, a capacitor 340 is connected between the input terminal and the output terminal of the second inverter 330 in parallel.

Figure 5C:
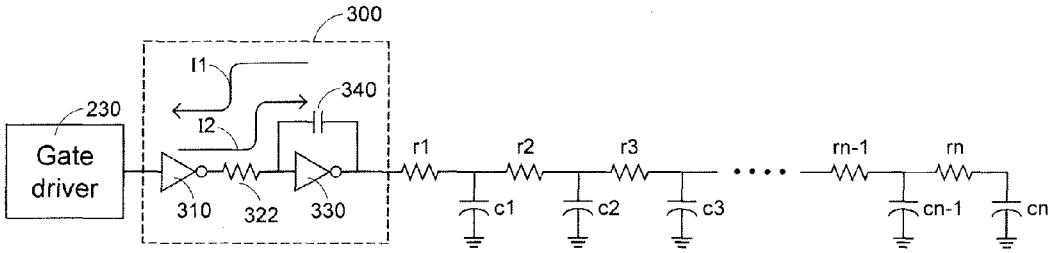
FIG. 5C is a schematic circuit diagram illustrating an equivalent circuit of a gate line circuit according to the first embodiment of the present invention.

FIG. 5C is a schematic circuit diagram illustrating an equivalent circuit of a gate line circuit according to the first embodiment of the present invention. When the driving signal generated by the gate driver 230 is quickly increased from the low-level state to the high-level state, the second inverter 330 will output a high-level voltage. Since the capacitor 340 is connected between the input terminal and the output terminal of the second inverter 330 in parallel, the driving signal outputted from the second inverter 330 does not quickly reach the high-level state. Meanwhile, a first charging current I1 generated from the output terminal of the second inverter 330 is transmitted to the output terminal of the first inverter 310 through the capacitor 340 and the resistor 322. As a consequence, the voltage across the capacitor 340 will be increased to the high-level state at a slower rate. In other words, the capacitor 340 is charged to the high-level state in a first direction.

When the capacitor 340 is charged to the high-level state in the first direction, the output terminal of the second inverter 330 will be slowly increased to the high-level state. That is, the sharp driving signal will become smoother by the control circuit 300. Under this circumstance, the switch units c1~cn are almost completely turned on at the same time.

On the other hand, when the driving signal generated by the gate driver 230 is quickly decreased from the high-level state to the low-level state, the second inverter 330 will output a low-level voltage. Since the capacitor 340 is connected between the input terminal and the output terminal of the second inverter 330 in parallel and a high-level voltage has been stored in the capacitor 340, the driving signal outputted from the second inverter 330 does not quickly reach the low-level state. Meanwhile, a second charging current I2 generated from the output terminal of the first inverter 310 is transmitted to the output terminal of the second inverter 330 through the resistor 322 and the capacitor 340. As a consequence, the high-level voltage stored in the capacitor 340 begins to discharge and the capacitor 340 is reversely charged by the second charging current I2 to the high-level state. In other words, the capacitor 340 is charged to the high-level state in a second direction.

When the capacitor 340 is charged to the high-level state in the second direction, the output terminal of the second inverter 330 will be slowly decreased to the low-level state. That is, the sharp driving signal will become smoother by the control circuit 300. Under this circumstance, the switch units c1~cn are almost completely turned off at the same time.

Since the capacitor 340 of the control circuit 300 could be charged in either the first direction or the second direction, the layout area of the capacitor 340 could be reduced while achieving the purpose of smoothing the driving signal.

Figure 6A:
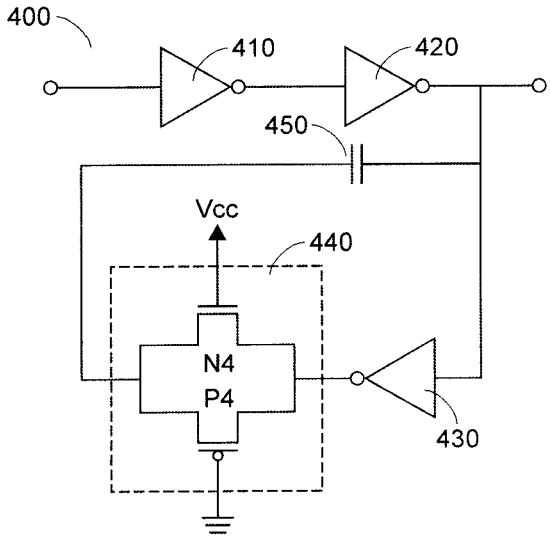
FIG. 6A is a schematic circuit diagram illustrating a control circuit of a display panel according to a second embodiment of the present invention.
Figure 6B:
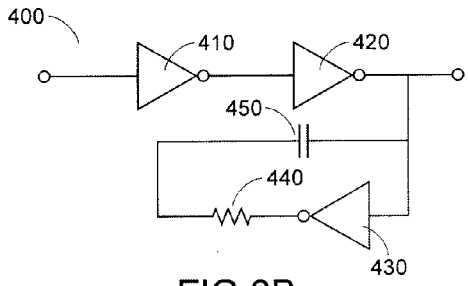
FIG. 6B is a schematic circuit diagram illustrating an equivalent circuit of the control circuit shown in FIG. 6A.

FIG. 6A is a schematic circuit diagram illustrating a control circuit of a display panel according to a second embodiment of the present invention. FIG. 6B is a schematic circuit diagram illustrating an equivalent circuit of the control circuit shown in FIG. 6A. The control circuit 400 comprises a first inverter 410, a second inverter 420, a third inverter 430, a resistor 440 and a capacitor 450.

The input terminal of the control circuit 400 is connected to the input terminal of the first inverter 410. The output terminal of the control circuit 400 is connected to the output terminal of the second inverter 420. The output terminal of the first inverter 410 is connected to the input terminal of the second inverter 420. The output terminal of the second inverter 420 is also connected to the input terminal of the third inverter 430. The resistor 440 and the capacitor 450 are serially connected between the input terminal and the output terminal of the third inverter 430.

The first inverter 410, the second inverter 420, the third inverter 430 and the capacitor 450 consist of transistors as described in the first embodiment. Alternatively, any of the inverters 410, 420 and 430 could be consisted of only n-type transistors or only p-type transistors.

The resistor 440 is a transmission gate including a fourth p-type transistor P4 and a fourth n-type transistor N4. The gate electrode of the fourth p-type transistor P4 and the gate electrode of the fourth n-type transistor N4 are respectively connected to the ground terminal and the source voltage Vcc. The source electrode of the fourth p-type transistor P4 and the source electrode of the fourth n-type transistor N4 are connected to the input terminal of the transmission gate. The drain electrode of the fourth p-type transistor P4 and the drain electrode of the fourth n-type transistor N4 are connected to the output terminal of the transmission gate. In other words, the both ends of the resistor 440 are the input terminal and the output terminal of the transmission gate, respectively.

Figure 6C:
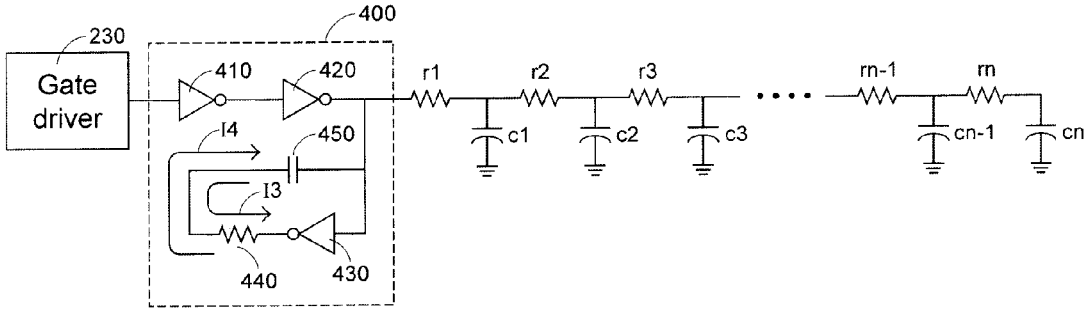
FIG. 6C is a schematic circuit diagram illustrating an equivalent circuit of a gate line circuit according to the second embodiment of the present invention.

FIG. 6C is a schematic circuit diagram illustrating an equivalent circuit of a gate line circuit according to the second embodiment of the present invention. When the driving signal generated by the gate driver 230 is quickly increased from the low-level state to the high-level state, the second inverter 420 of the control circuit 400 will output a high-level voltage. Since the resistor 440 and the capacitor 450 are serially connected between the input terminal and the output terminal of the third inverter 430, the driving signal outputted from the second inverter 420 does not quickly reach the high-level state. Meanwhile, a third charging current I3 generated from the output terminal of the second inverter 420 is transmitted to the output terminal of the third inverter 430 through the capacitor 450 and the resistor 440. As a consequence, the voltage across the capacitor 450 will be increased to the high-level state at a slower rate. In other words, the capacitor 450 is charged to the high-level state in a first direction.

When the capacitor 450 is charged to the high-level state in the first direction, the output terminal of the second inverter 420 will be slowly increased to the high-level state. That is, the sharp driving signal will become smoother by the control circuit 400. Under this circumstance, the switch units c1~cn are almost completely turned on at the same time.

On the other hand, when the driving signal generated by the gate driver 230 is quickly decreased from the high-level state to the low-level state, the second inverter 420 will output a low-level voltage. Since the resistor 440 and the capacitor 450 are serially connected between the input terminal and the output terminal of the third inverter 430 and a high-level voltage has been stored in the capacitor 450, the driving signal outputted from the second inverter 420 does not quickly reach the low-level state. Meanwhile, a fourth charging current I4 generated from the output terminal of the third inverter 430 is transmitted to the output terminal of the second inverter 420 through the resistor 440 and the capacitor 450. As a consequence, the high-level voltage stored in the capacitor 450 begins to discharge and the capacitor 450 is reversely charged by the fourth charging current I4 to the high-level state. In other words, the capacitor 450 is charged to the high-level state in a second direction Since the capacitor 450 of the control circuit 400 could be charged in either the first direction or the second direction, the capacitance value and the layout area of the capacitor 340 could be reduced while achieving the purpose of smoothing the rising and falling edge slopes of the driving signal.

When the smoother driving signal is transmitted from the control circuit 400 to all switch units c1~cn, the switch units c1~cn are almost completely turned on or turned off at the same time. Since the feed-through voltage effects for all pixel elements are substantially identical, the or the images shown on the display panel will become more consistent.

Figure 7:
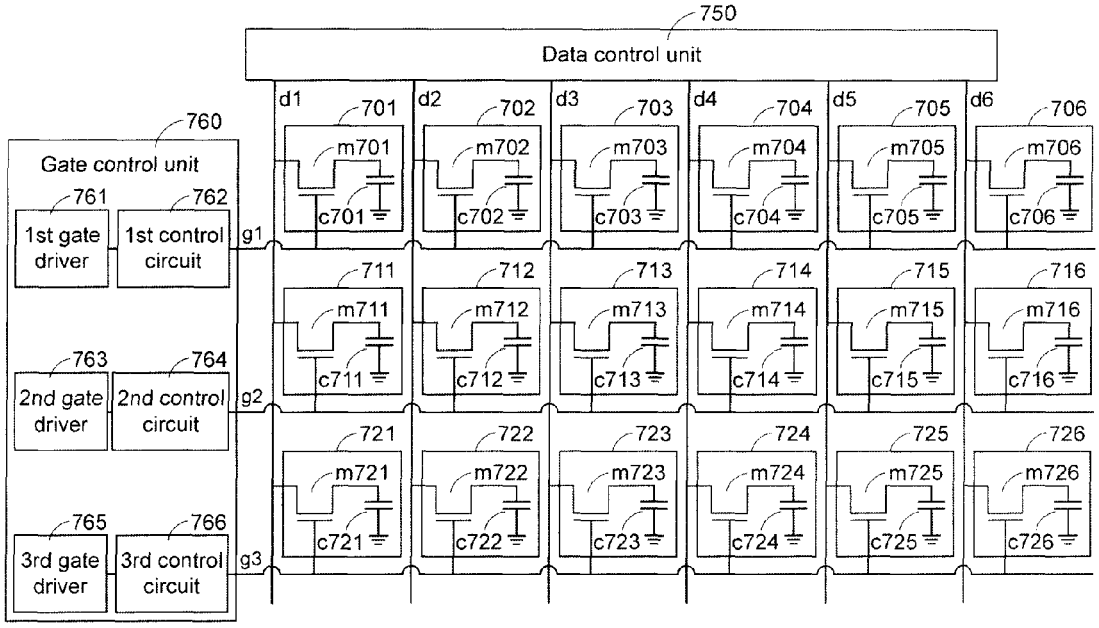
FIG. 7 is a schematic circuit diagram illustrating a display panel according to an embodiment of the present invention.

FIG. 7 is a schematic circuit diagram illustrating a display panel according to an embodiment of the present invention. As shown in FIG. 7, the display panel comprises multiple pixel elements 701~726, which are arranged in an array. Each of the pixel elements 701~726 comprises a storage unit c701~c726 and a switch unit m701~m726. For example, the storage unit c701~c726 are capacitors, and the switch units m701~m726 are transistors.

In addition, the display panel further comprises a data control unit 750 and a gate control unit 760. The gate control unit 760 is connected with multiple gate lines g1~g3. The data control unit 750 is connected to multiple data lines d1~d6. When the switch units m701~m726 are turned on under control of a gate control unit 760, pixel data are inputted and stored into respective storage unit c701~c726 via the data lines d1~d6. As the size of the display panel is increased, there are more pixel elements, gate lines and data lines on the display panel. Please refer to FIG. 7 again. The gate control unit 760 further comprises multiple gate drivers and multiple control circuits. In this embodiment, the gate control unit 760 comprises a first gate driver 761, a first control circuit 762, a second gate driver 763, a second control circuit 764, a third gate driver 765 and a third control circuit 766. The output terminals of the control circuits 762, 764 and 766 are connected to the gate lines g1, g2 and g3, respectively.

Figure 8:
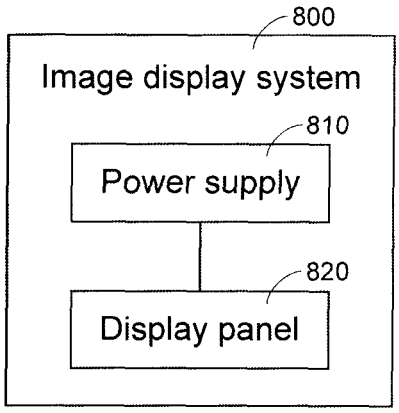
FIG. 8 is a schematic functional block diagram illustrating an image display system of the present invention.

FIG. 8 is a schematic functional block diagram illustrating an image display system of the present invention. The image display system 800 comprises a power supply 810 and a display panel 820. The power supply 810 is electrically connected to the display panel 820 for providing electric energy to power the display panel 820. The configurations and the operations of the display panel 820 are similar to those shown in FIG. 7, and are not redundantly described herein. The display panel 820 includes the above-mentioned gate line circuit. As a consequence, the brightness or the images shown on the display panel 820 of the image display system 800 of the present invention will become more consistent.

An example of the image display system 800 includes but is not limited to a mobile phone, a digital camera, a personal digital assistant, a notebook computer, a desktop computer, a TV set, a global positioning system (GPS), an automotive display system, a flight display system, a digital photo frame, a portable DVD player, and the like.

The display panel of the present invention can be applied to an AMOLED (active matrix organic light emitting diode) device or a LCD (liquid crystal display) device.

While the invention has been described in terms of what is presently considered to be the most practical and preferred embodiments, it is to be understood that the invention needs not to be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A display panel comprising a gate line circuit, the gate line circuit comprising:

a gate driver having an output terminal for generating a first driving signal with alternate high and low levels, wherein the first driving signal has a first rising edge and a first falling edge;

a control circuit having an input terminal connected to the output terminal of the gate driver for receiving the first driving signal and an output terminal for generating a second driving signal, wherein the second driving signal has a second rising edge and a second falling edge, and the second rising edge and the second falling edge of the second driving signal are respectively smoother than the first rising edge and the first falling edge of the first driving signal; and a gate line connected to the output terminal of the control circuit, wherein the control circuit comprises:

at least one capacitor, the at least one capacitor is charged in a first direction in response to the first rising edge of the first driving signal, and the at least one capacitor is charged in a second direction in response to the first falling edge of the first driving signal;

a first inverter having an input terminal connected to the input terminal of the control circuit;

a resistor; and a second inverter having an input terminal connected to an output terminal of the first inverter through the resistor, wherein the at least one capacitor is interconnected between the input terminal of the second inverter and an output terminal of the second inverter, and the output terminal of the second inverter is connected to the output terminal of the control circuit.

2. The display panel according to claim 1, wherein the display panel further comprises a plurality of multiple switch units connected with the gate line, and wherein the plurality of switch units are turned on or turned off according to the second driving signal.

3. The display panel according to claim 2, wherein the plurality of switch units are disposed within respective pixel elements, and corresponding pixel data are inputted and stored into respective storage unit of the pixel elements when the plurality of switch units are turned on.

4. The display panel according to claim 1, wherein the first inverter comprises:

a first p-type transistor having a source electrode connected to a source voltage; and a first n-type transistor having a source electrode connected to a ground terminal, wherein a gate electrode of the first p-type transistor and a gate electrode of the first n-type transistor are connected to the input terminal of the first inverter, and a drain electrode of the first p-type transistor and a drain electrode of the first n-type transistor are connected to the output terminal of the first inverter.

5. The display panel according to claim 1, wherein the resistor comprises:

a second p-type transistor having a gate electrode connected to a ground terminal; and a second n-type transistor having a gate electrode connected to a source voltage, wherein a source electrode of the second p-type transistor and a source electrode of the second n-type transistor are connected to a first end of the resistor, and a drain electrode of the second p-type transistor and a drain electrode of the n-type transistor are connected to a second end of the resistor.

6. The display panel according to claim 1, wherein the at least one capacitor is defined by a fourth transistor, a gate electrode of the fourth transistor is connected to a first end of the at least one capacitor, and a drain electrode and a source electrode of the fourth transistor are connected to a second end of the at least one capacitor.

7. The display panel according to claim 1, wherein the display panel is an active matrix organic light emitting diode display panel or a liquid crystal display panel.

8. An image display system, comprising:

the display panel according to claim 1; and a power supply electrically connected to the display panel for providing electric energy to power the display panel.

9. The image display system according to claim 8, wherein the image display system is a mobile phone, a digital camera, a personal digital assistant, a notebook computer, a desktop computer, a TV set, a global positioning system, an automotive display system, a flight display system, a digital photo frame or a portable DVD player.

* * * * *